United States Patent [19]

Pringle

[11] 4,045,829

[45] Sept. 6, 1977

[54] SOFA BED ASSEMBLY

[75] Inventor: William L. Pringle, Grosse Pointe Shores, Mich.

[73] Assignee: United States Steel Corporation, Pittsburgh, Pa.

[21] Appl. No.: 708,912

[22] Filed: July 26, 1976

[51] Int. Cl.[2] ..... A47C 17/14

[52] U.S. Cl. ..... 5/18 R; 5/29; 5/51 K

[58] Field of Search ..... 5/13, 14, 17, 18, 26, 5/28–31, 41, 47, 48, 51 K

[56] References Cited

U.S. PATENT DOCUMENTS

| | | | |
|---|---|---|---|
| 1,078,044 | 11/1913 | Goldstein | 5/26 D |
| 2,584,145 | 2/1952 | Martin | 5/14 |
| 3,383,716 | 5/1968 | Biancalani | 5/14 |
| 3,925,834 | 12/1975 | Johnson | 5/29 |
| 3,975,783 | 8/1976 | Pringle | 5/18 R |

*Primary Examiner*—Casmir A. Nunberg
*Attorney, Agent, or Firm*—McGlynn and Milton

[57] ABSTRACT

A furniture assembly movable between a sitting configuration and a bed configuration including a support frame, a foldable bed frame supported by the support frame and movable between a folded and an unfolded position, the bed frame including an inner frame member supported by the support frame and an outer frame member pivotally movable between an extended position wherein it is generally coplanar with respect to the inner frame member and a folded position wherein it is located above the inner frame member, the inner and outer frame members defining a space therebetween when in the folded position for containing bedding material; guide means, such as tracks or the like, interconnect the support frame and the bed frame for guiding the movement of the bed frame between a stored position within the support frame and a deployed position in which the bed frame may be moved to the unfolded position; the assembly further including a closure device, such as a pivoted arm, operative when the bed frame is in the folded position and is being moved from the deployed to the stored position for forcing the outer frame member to follow a predetermined route whereby the bedding material is compressed and is prevented from causing the outer frame member to interfere with the support frame during such movement.

16 Claims, 5 Drawing Figures

SOFA BED ASSEMBLY

This invention relates to a furniture assembly which is movable between a sitting configuration and a bed configuration, such assemblies being generally referred to as a sofa bed.

As is well-known, a sofa bed is an upholstered couch with fixed back and arms which can be opened into a double bed. The sofa bed includes a foldable bed portion which is received within a cavity formed by the frame of the sofa portion for storing the bed portion when it is not in use. The bed portion normally includes a foldable frame which is adapted to support a mattress and other bedding material. The bed portion can be moved to a deployed position by lifting the bed frame out of the sofa frame. In the deployed position the bed frame can be unfolded into a double bed. As suggested, the bed frame supports bedding material consisting of a mattress, sheets, blankets, etc. For purposes of convenience, it is intended that the mattress be folded with the bed frame so that it also is stored within the cavity in the sofa frame. On occasion other bedding material, such as sheets and blankets, may remain on the mattress when the bed frame is folded. In order to move the folded bed portion into the recess in the sofa frame, the bed frame must be folded properly. Due to their bulk, the mattress and other bedding material oftentimes hinder proper folding of the bed frame. Consequently, it is difficult to move the bed portion into the recess in the sofa frame because portions of the bed frame are not able to clear the backrest of the sofa frame. While this problem can be remedied by pressing down on the bed frame to further compress the bedding material, this procedure is inconvenient and oftentimes impossible for one person to accomplish.

This invention provides means for automatically compressing the bedding material while the folded bed frame is being moved to the stored position in the cavity of the sofa frame to insure that the folded bed frame will clear all portions of the sofa frame. More specifically, the frame assembly includes closure means operative when the bed frame is in the folded position and is being moved from a deployed position to the stored position for forcing the upper member of the bed frame to follow a predetermined route thereby preventing the bedding material from causing the bed frame to interfere with the sofa frame during such movement.

Other advantages of the present invention will be readily appreciated as the same becomes better understood by reference to the following detailed description when considered in connection with the accompanying drawings wherein.

Figure 1:
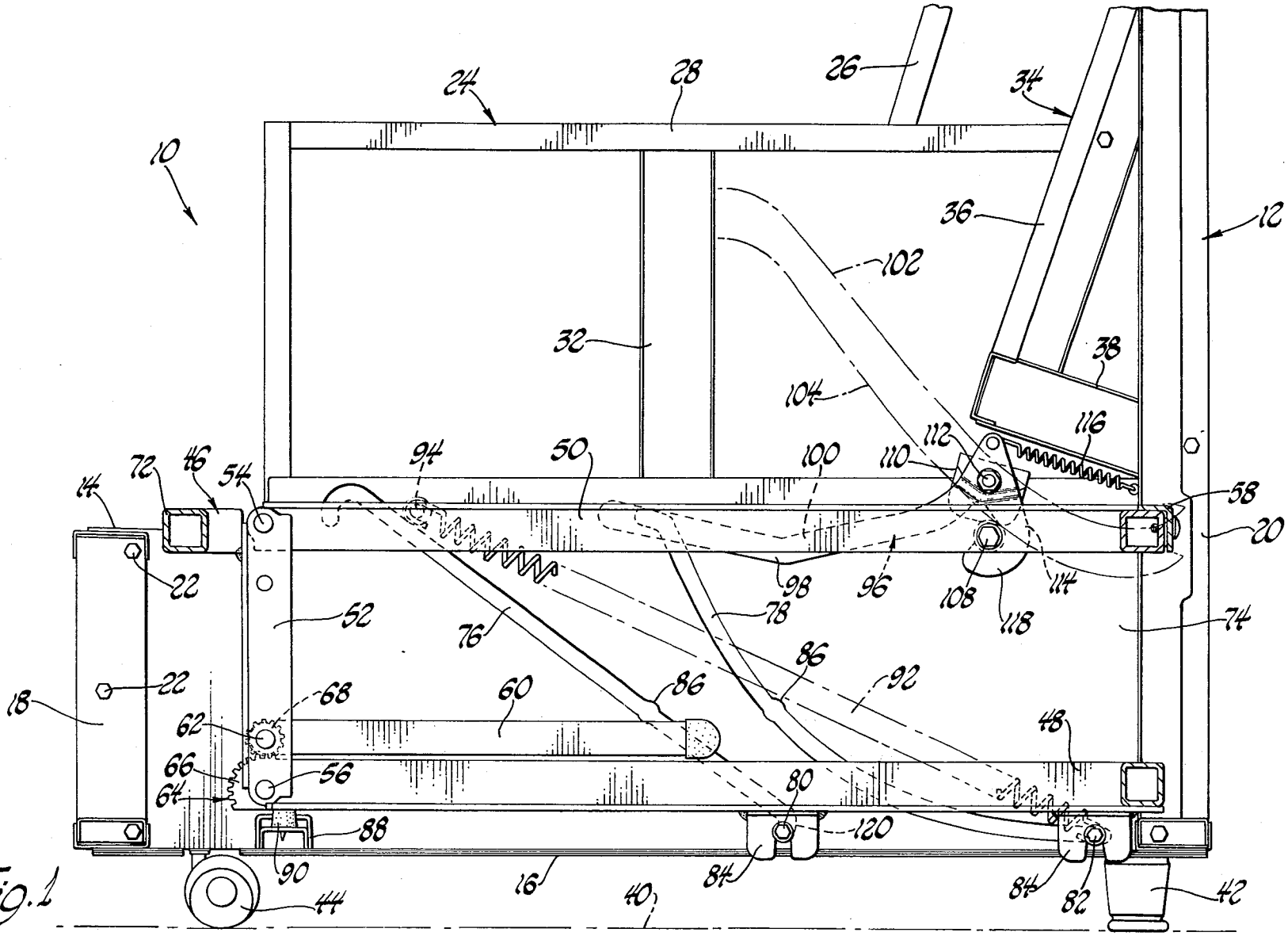
FIG. 1 is a cross-sectional elevational view of a furniture assembly constructed in accordance with the instant invention.

Referring more particularly to the drawings, a furniture assembly constructed in accordance with the instant invention is generally shown at 10 in FIG. 1. The assembly includes a support frame generally indicated at 12 which defines the sofa portion of the assembly. The support frame 12 includes a generally rectangular base 14 which is constructed of suitable metal framing elements. More specifically, the base 14 includes a lower framing element 16, a front framing element 18 and a rear framing element 20. These framing elements comprise suitable metal channels, such as C-channels, and are assembled in any suitable fashion, such as by the use of bolts 22. The base 14 supports an arm rest generally indicated at 24 which consists of channel members 26, 28, 30 and 32. The rear framing element 20 extends above the base 14 and supports a backrest portion generally indicated at 34. The backrest portion 34 includes an upwardly and rearwardly slanted member 36 and a brace member 38. The entire sofa frame 12 is supported on a support surface 40 by means of legs 42 and castors 44.

A foldable bed frame, generally indicated at 46, is supported by the support frame 12 and is received for storge within the cavity defined by the base 14 of the support frame 12. As shown in FIG. 1, the bed frame 46 is in the stored position within the support frame 12.

The bed frame 46 includes an inner frame member 48 which, as will be more clearly described, is supported by the support frame 12, an outer frame member 50 and an intermediate frame member 52. The intermediate frame member 52 is pivotally connected to the outer frame member 50 at 54 and is pivotally connected to the inner frame member 48 at 56. The pivotal connections between the frame members permits movement of the bed frame between a folded and an unfolded position. As shown in FIG. 1, when the bed frame is folded, the outer frame member 50 is located above the inner frame member 48 and spaced therefrom a distance approximately equal to the length of the intermediate frame member 52. Thus, there is a space defined between the inner and outer frame members. This space is for storing the folded bedding material.

Figure 2:
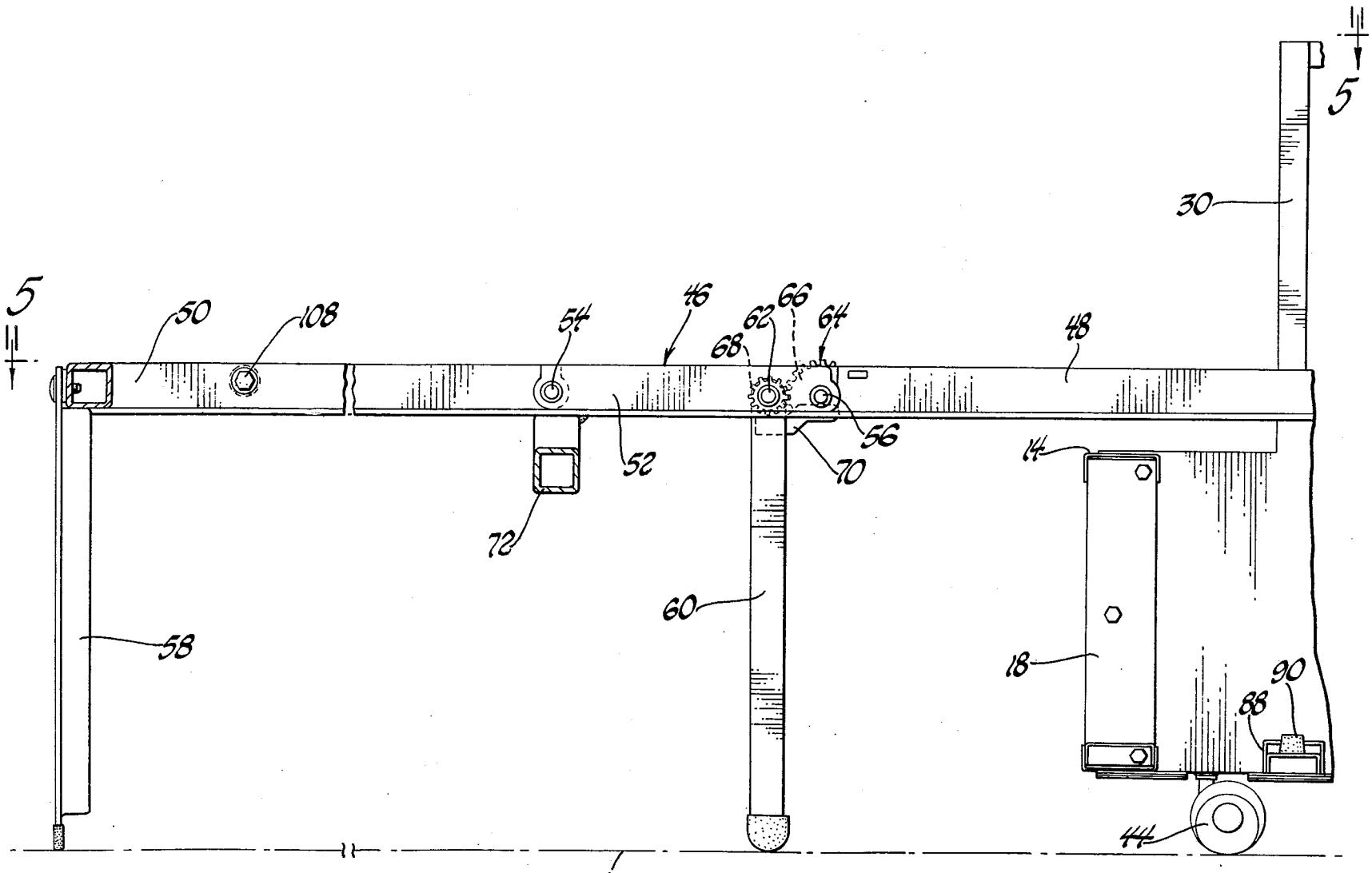
FIG. 2 is a cross-sectional elevational view of a portion of the bed frame in the unfolded position.

The outer frame member 50 includes a leg member 58 at each end thereof which is pivotally connected thereto so that it is movable between a supporting and a collapsed position. As shown more clearly in FIG. 2, when the bed frame 46 is moved to the unfolded position, the leg 58 is manually pivoted downwardly from the outer frame member 50 into supporting engagement with a support surface 40. The intermediate frame member 52 also includes a leg member 60 at each end thereof which is also movable between supporting and collapsed positions for supporting the intermediate frame member 52 when the bed frame 46 is in the unfolded position. Means is provided for automatically moving the leg members 60 between supporting and collapsed positions during relative pivotal movement between the inner frame member 48 and the intermediate frame member 52. Specifically, the leg member 60 is pivotally connected to the intermediate frame member 52 at 62. The inner frame member 48 is provided with means 64 for interfering with the leg member 60 during the relative pivotal movement between the inner frame member 48 and the intermediate frame member 52. Such means includes a stationary toothed plate or rack 66 which meshes with a gear 68 attached to the leg 60. The gear 68 has an axis of rotation which corresponds to the pivot axis of the leg 60. When the bed frame 46 is unfolded each leg 60 is forced to pivot about its pivot axis from its collapsed position, best shown in FIG. 1, to a supporting position as shown in FIG. 2. Conversely, when the bed frame 46 is moved from the unfolded to the folded position, the legs 60 are forced to pivot to the collapsed position. A stop member 70 is attached to the inner frame member 48 to limit the pivotal movement of the leg 60 to define a supporting position. This leg assembly is disclosed in a copending patent application of the inventor, Ser. No. 585,684, filed June 10, 1975.

The bed frame 46 is also provided with a handle 72 which is welded to the intermediate frame member 52. As shown in FIG. 1, when the bed frame 46 is folded and in the stored position within the support frame 12, the handle 72 extends along the forward and upper portion of the cavity in the sofa frame so that it can be easily manually grasped for lifting the bed frame 46 out of the cavity.

In order to support and guide the bed frame 46, each end of the base 14 of the support frame 12 is provided with a plate member 74. Both of the plate members 74 are identical and each includes a pair of tracks 76 and 78. A pair of shafts 80 and 82 are connected to each end of the inner frame member 48. Each of the shafts 80 and 82 rotatably supports a roller (not shown). The rollers are received in the tracks 76 and 78 to guide the movement of the bed frame 46. A preferred design of the roller and track arrangement is shown and described in the aforementioned patent application of the inventor. Suffice it to say, however, that the shafts 80 and 82 are received in slotted or bifurcated brackets 84 and are held in place by suitable threaded fasteners. Enlarged portions 86 are provided in the tracks 76 and 78 for allowing insertion of the roller into the track. In short, the enlarged portions of the track 86 and the slotted brackets 84 are features which facilitate the assembly of the unit. Specifically, the rollers may be lotated in the tracks 76 and 78 and the bed frame 46 is then lowered onto the shafts 80 and 82 and securely fastened thereto. A support block 88 including a rubber pad 90 is secured to the lower framing element 16 of the base 14 to support the front of the bed frame 46 as shown in FIG. 1.

Figure 3:
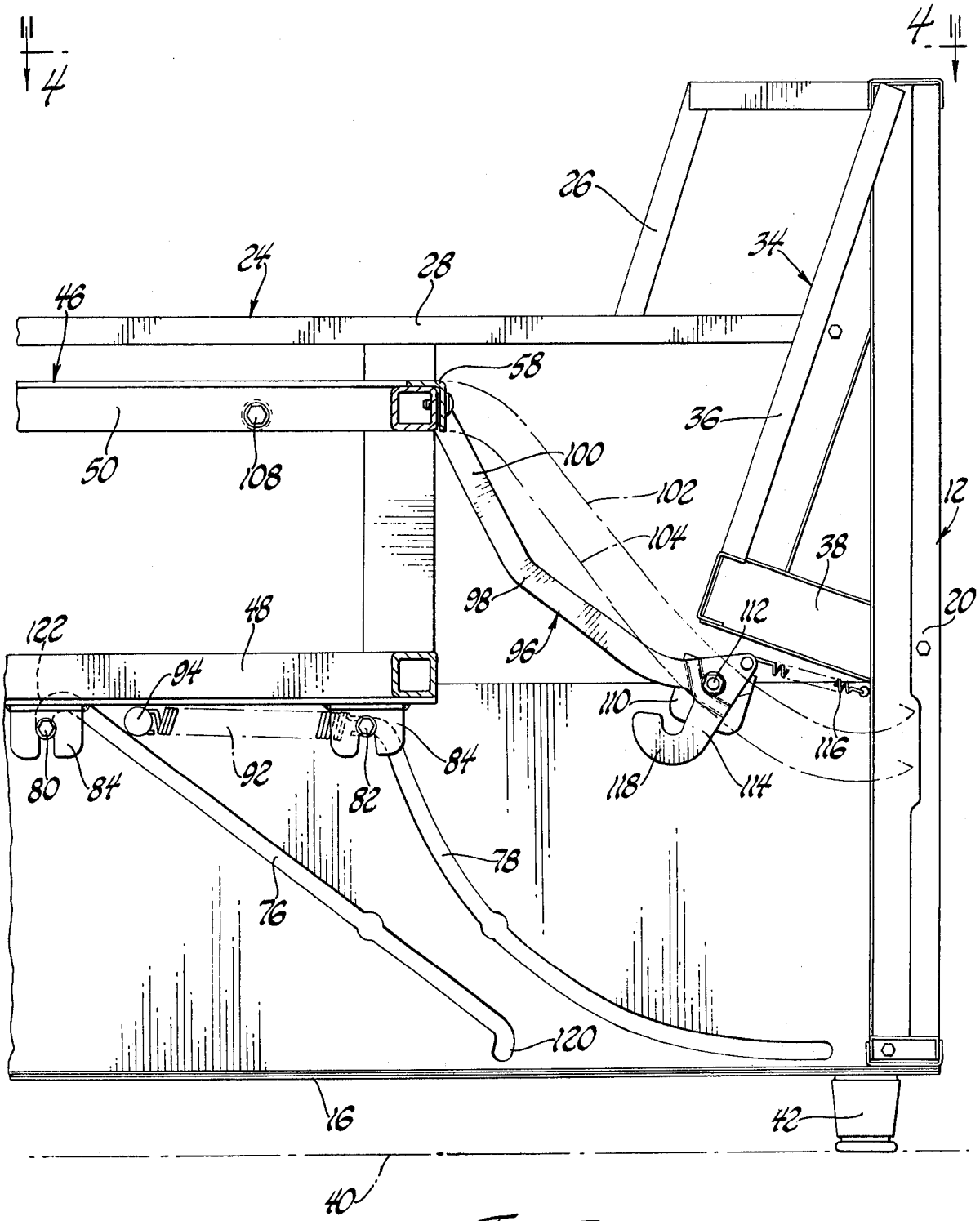
FIG. 3 is a cross-sectional elevational view in which the folded bed frame is in a deployed position above the cavity in the sofa frame.
Figure 4:
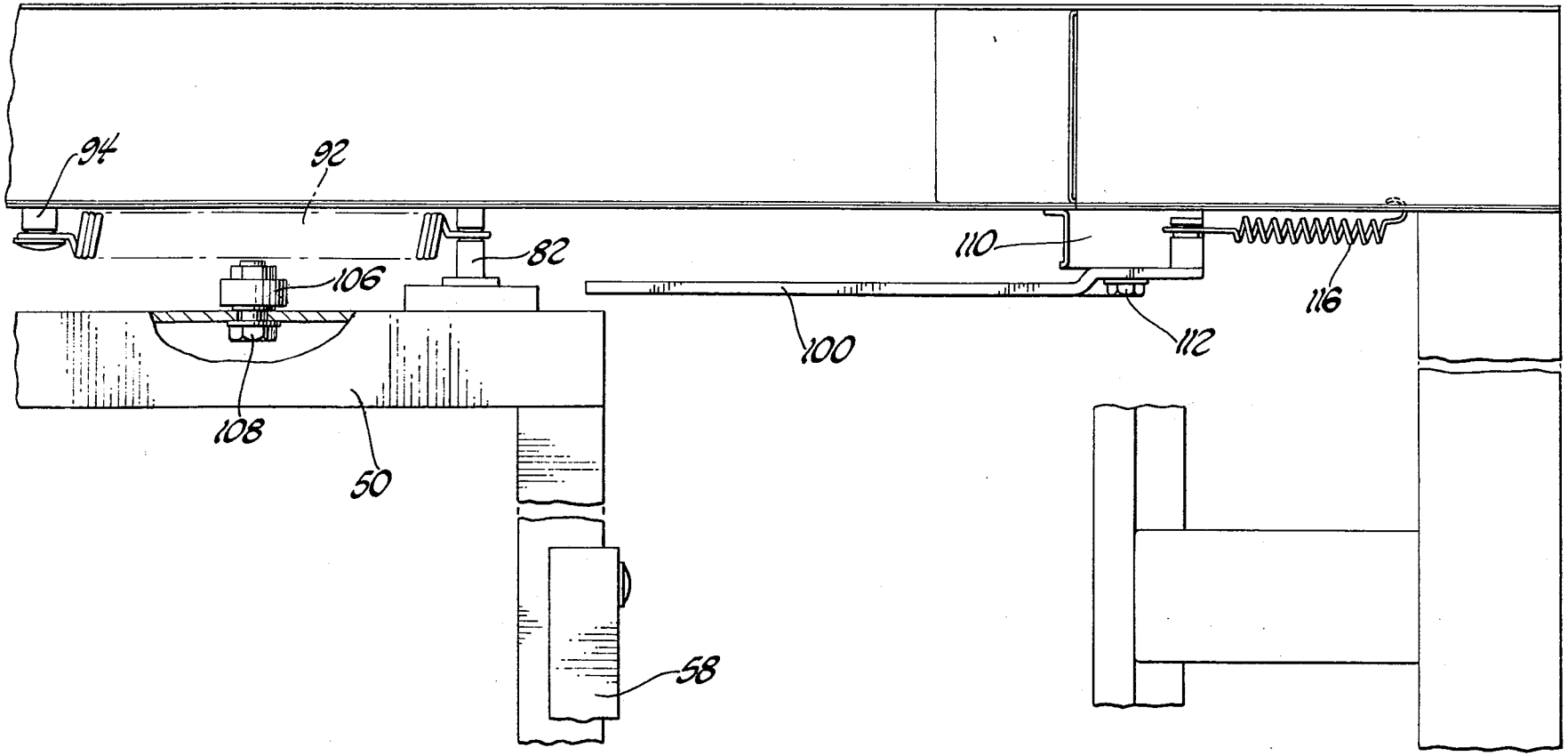
FIG. 4 is a view taken generally along line 4—4 of FIG. 3.
Figure 5:
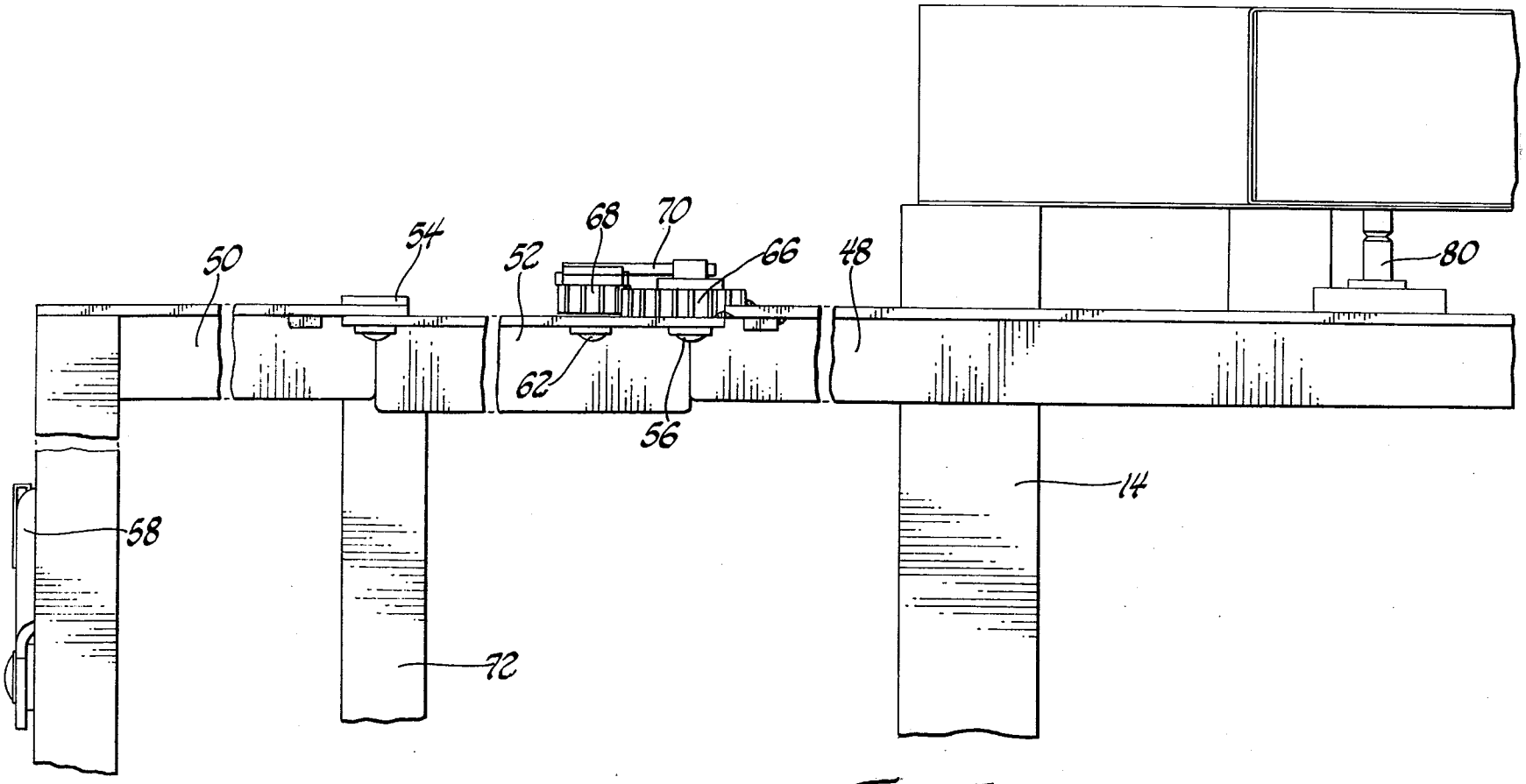
FIG. 5 is a view taken generally along line 5—5 of FIG. 2.

In order to facilitate movement of the bed frame 46 from the stored position shown in FIG. 1 to the deployed position shown in FIG. 3, a coil spring 92 is provided at each end of the bed frame 46. The coil spring 92 is secured between a stud 94 which is attached to the support frame 12 and the rear shaft 82 on the bed frame 46. As shown in FIG. 1, the coil spring 92 is extended when the bed frame 46 is in the stored position. When the bed frame 46 is moved toward the deployed position shown in FIG. 3, the coil springs 92 provide a lifting force which helps to counterbalance the weight of the bed frame 46.

The assembly also includes closure means generally indicated at 96 which is operative when the bed frame 46 is in the folded position and is being moved from the deployed position, shown in FIG. 3, to the stored position, shown in FIG. 1, for forcing the outer frame member 50 to follow a predetermined route. This, in turn, prevents the bedding material from causing the outer frame member 50 to interfere with the support frame 12 during such movement. In other words, by forcing the outer frame member 50 to follow a predetermined route, the outer frame member 50 is forced to pivot toward the inner frame member 48 against the resistance of the bedding material therebetween in the event that the bedding material is bulky enough to prevent proper folding of the bed frame 46.

The closure means 96 includes a cam surface 98 which, in the preferred embodiment of the invention, consists of the leading edge of a closure arm 100 which is supported by the support frame 12. The outer frame member 50 includes a portion which engages and moves along the cam surface 98 as the bed frame 46 is moved from the deployed to the stored position. Hence, the upper frame member 50 is forced to travel along a route which is determined by the cam surface 98 on the closure arm 100. The route of the upper and lower corners of the outer frame member 50 is shown in broken lines 102 and 104 in FIGS. 1 and 3. The cooperating portion of the bed frame 46 which engages the closure arm 100 consists of rollers 106 which are connected to each end of the outer frame member 50 by means of a bolt and nut arrangement 108, the bolt defining a shaft on which the roller 106 rotates. It is again pointed out that only one side of the assembly is shown and that a closure arm 100 is mounted on the support frame at each end of the bed frame while each end of the bed frame includes a cooperating roller 106.

The closure arm 100 is pivotally supported by a bracket 110 through a nut and bolt assembly 112. The closure arm 100 also includes a lever portion 114 at the end of the cam surface 98. As the bed frame 46 approaches the stored position, the roller 106 leaves the cam surface 98 and engages the lever portion 114. Further movement of the bed frame 46 causes the closure arm 100 to pivot in a counterclockwise direction from the operative position shown in FIG. 3 to a retracted position shown in FIG. 1. In the retracted position, the closure arm 100 lies between the bed frame 46 and the support frame 12 in an out-of-the-way position so that cushions can be received on top of the bed frame 46 for using the assembly in the sofa configuration. As indicated in FIGS. 1 and 3, the closure arm 100 forces the outer frame member 50 of the bed frame 46 to follow a route which will guide it below the brace member 38 of the backrest portion 34. Heretofore, due to its bulk, the bedding material often resisted proper folding of the bed frame 46 so that the outer frame member 50 could not be moved below the brace 38 without a great deal of effort. In other words, the outer frame member 50 was held away from its proper position by the bedding material thus requiring additional effort to move the bed frame 46 to the stored position. As should be apparent from the foregoing, the closure means 96 solves this problem.

A coil spring 116, which is connected between the support frame 12 and the closure arm 100, pivots the closure arm 100 from the retracted position to the operative position as the bed frame 46 is moved from the stored position to the deployed position. Thus, the coil spring 116 automatically moves the closure arm 100 to the operative position when the bed frame is deployed.

The closure arm 100 also includes a support portion 118 which consists of an inwardly curved extension of the lever portion 114. The support portion captures or cradles the roller 106 of the outer frame member 50 when the bed frame 46 is in the stored position to provide vertical support for the outer frame member 50. In other words, the support portion 118 prevents further downward movement of the outer frame member 50 so that it is capable of supporting the weight of a person or persons sitting on the sofa.

The above-described assembly operates in the following manner. When it is desired to convert the sofa bed from the sofa configuration to the bed configuration, the cushions on the sofa are removed to expose the underlying bed frame 46. In the stored position, the forward shaft 80 on the inner frame member 48 is located in a jog section 120 of the track 76 which is angled with respect to the major portion of the track 76. Thus located, the shaft 80 engages the forward edge of the track to prevent inadvertent movement of the bed frame 46 by reason of the coil spring 92. In order to move the bed frame 46 toward the deployed position, the handle 72 is grasped and the front end 46 of the bed frame is lifted thereby causing the bed frame 46 to pivot about the rear shaft 82 thus lifting the shaft 80 out of the jog portion 120 of the track 76 and into the generally straight portion. At this point, the bed frame is pulled outwardly and upwardly assisted by the coil spring 92, the movement of the bed frame 46 being guided by the tracks 76 and 78. The bed frame 46 is moved upwardly until it reaches the position shown in FIG. 3, i.e., the deployed position where, as shown, the coil spring 92 has fully collapsed. In order to securely locate the inner frame member 48 of the bed frame 46, the track 76 is provided with a downwardly curved portion 122 which seats the shaft 80. This prevents inadvertent forward or rearward movement of the inner frame member 48 with respect to the support frame 12. In the deployed position, the elements are arranged as shown in FIG. 3. It is noted that the closure arm 100 is pivoted in a clockwise direction to the operative position as the bed frame 46 is moved to the deployed position, such movement being caused by the coil spring 116.

At this point, the bed frame 46 is moved to an unfolded position as shown in FIG. 2. As the bed frame 46 is unfolded, the legs 60 which support the intermediate frame member 52 are automatically pivoted to the supporting position by means of the gear 68 and rack 66 arrangement. Additionally, the leg members 58 on the outer frame member 50 are manually pivoted from the collapsed to the supporting position. In the unfolded position, the frame members 48, 50 and 52 define a flat, horizontal surface for supporting the bedding material.

When it is desired to reconvert the assembly to the sofa configuration, the legs 58 are pivoted to their collapsed positions and the outer frame member 50 is lifted and folded over the inner frame member 48. This movement automatically pivots the legs 60 from the supporting position to the collapsed position. Additionally, the bedding material is simultaneously folded so that it is sandwiched between the inner and outer frame members 48 and 50. This activity returns the bed frame 46 to the deployed position shown in FIG. 3. The bed frame 46 is then lifted upwardly by means of the handle 72 causing the bed frame 46 to pivot about the rear shaft 82. This movement lifts the forward shafts out of the curved portions 122 in the track 76 so that the bed frame 46 can be moved down the tracks 76 and 78. As the bed frame 46 is moved downwardly along the tracks 76 and 78, the roller 106 contacts the cam surface 98 on the closure arm 100. In the event that the bedding material has prevented the outer frame member 50 from being folded properly, the closure arm 100 will force the outer frame member 50 to pivot toward the inner frame member 48 thus compressing the bedding material. Such action continues as the bed frame 46 is moved toward the stored position so that the leading edges of the outer frame member 50 are forced to follow the predetermined routes 102 and 104 shown. During this movement, the closure arm 100 remains stationary. When the roller 106 leaves the cam surface 98 and engages the lever portion 114, further movement of the bed frame 46 pivots the closure arm 100 in a counterclockwise direction toward the retracted position against the resistance of the coil spring 116. When the bed frame 46 reaches the stored position, the shafts 108 are cradled in the support portions 118 of the closure arm 100 thereby supporting the otherwise free end of the outer frame member 50. It should also be appreciated that during this movement the spring 92 is extended to assist subsequent movement of the bed frame 46 back to the deployed position.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A furniture assembly movable between a sitting configuration and a bed configuration comprising:

a support frame;

a foldable bed frame supported by said support frame and movable between a folded and an unfolded position, said bed frame including an inner frame member supported by said support frame and an outer frame member pivotally movable between an extended position wherein it is generally coplanar with respect to said inner frame member and a folded position wherein it is located above said inner frame member, said inner and outer frame members defining a space therebetween when in said folded position for containing bedding material;

guide means interconnecting said support frame and said bed frame for guiding the movement of said bed frame between a stored position within said support frame and a deployed position in which said bed frame may be moved to the unfolded position; and closure means operative when said bed frame is in the folded position and is being moved from the deployed to the stored position for engaging and forcing said outer frame member to follow a predetermined route whereby said bedding material is prevented from causing said outer frame member to interfere with said support frame during such movement.

2. An assembly as set forth in claim 1 wherein said closure means includes a cam surface and said outer frame member includes a cooperating portion which engages and moves along said cam surface as said bed frame is moved from the deployed to the stored position.

3. An assembly as set forth in claim 1 wherein said closure means includes a closure arm supported by said support frame, said arm including a cam surface and said outer frame member includes a cooperating portion which engages and moves along said cam surface as said bed frame is moved from the deployed to the stored position to guide said bed frame along a preferred route.

4. An assembly as set forth in claim 3 wherein said support frame includes a bracket for pivotally supporting said closure arm to permit movement of said closure arm between operative and a retracted position.

5. An assembly as set forth in claim 4 wherein said closure arm includes a lever portion at the end of said cam surface which is engaged and moved by said cooperating portion on said bed frame as said bed frame approaches the stored position to pivot said closure arm from the operative to the retracted position.

6. An assembly as set forth in claim 5 wherein said closure arm includes a support portion for capturing said cooperating portion of said outer frame member when said bed frame is in the stored position to provide vertical support for said outer frame member.

7. An assembly as set forth in claim 6 wherein said support portion includes a curved extension of said lever portion.

8. An assembly as set forth in claim 7 wherein said closure means includes a spring member connected between said closure arm and said support frame for urging said closure arm toward said operative position.

9. An assembly as set forth in claim 8 including a pair of said closure arms, one being located at each side of said support frame.

10. An assembly as set forth in claim 9 wherein said cooperating portion on said outer frame member includes a pair of rollers.

11. An assembly as set forth in claim 10 wherein said guide means includes track means supported by said support frame and rollers supported by said inner frame member cooperating with said track means.

12. An assembly as set forth in claim 11 wherein said bed frame includes an intermediate frame member between said inner and outer frame members and pivotally connected to each.

13. An assembly as set forth in claim 12 wherein said intermediate frame member includes leg members movable between supporting and collapsed positions for supporting said intermediate frame member when said bed frame is in the unfolded position.

14. An assembly as set forth in claim 13 wherein said inner frame member includes means for interfering with said leg members on said intermediate frame member during relative pivotal movement between said inner and intermediate frame members to automatically move said leg members between said supporting and collapsed positions.

15. An assembly as set forth in claim 14 wherein said outer frame member includes leg members movable between supporting and collapsed positions for supporting said outer frame member when said bed frame is in the unfolded position.

16. An assembly as set forth in claim 1 wherein said support frame includes a spring member connected to said bed frame for urging said bed frame from said stored position toward said deployed position.

* * * * *